US005104051A

United States Patent [19]

Berg et al.

[11] Patent Number: 5,104,051

[45] Date of Patent: Apr. 14, 1992

[54] DEVICE FOR CONSTRUCTING A THREAD RESERVE WOUND PARALLEL ONTO A BOBBIN IN A WINDER

[75] Inventors: Lothar Berg, Eschwege; Manfred Degenhardt, Wehretal; Herbert Rabe, Ringgau, all of Fed. Rep. of Germany

[73] Assignee: Georg Sahm GmbH & Co. KG, Eschwege, Fed. Rep. of Germany

[21] Appl. No.: 550,532

[22] Filed: Jul. 10, 1990

[30] Foreign Application Priority Data

Jul. 11, 1989 [DE] Fed. Rep. of Germany ..... 3922719

[51] Int. Cl.[5] ..... B65H 54/00; B65H 67/044

[52] U.S. Cl. ..... 242/18 PW; 242/18 EW

[58] Field of Search ..... 242/18 PW, 18 EW

[56] References Cited

U.S. PATENT DOCUMENTS

| | | | |
|---|---|---|---|
| 2,919,080 | 12/1959 | Moore | 242/157 |
| 2,936,962 | 5/1960 | Hausel | 242/18 PW |
| 3,075,715 | 1/1963 | Heasen et al. | 242/18 PW |
| 3,130,938 | 4/1964 | Dysart | 242/157 R |
| 3,940,075 | 1/1976 | Lenk | 242/18 PW |
| 3,964,721 | 6/1976 | Owens et al. | 242/18 PW |
| 4,102,508 | 7/1978 | Steyelman | 242/18 PW |
| 4,111,375 | 9/1978 | Dolle | 242/18 PW |
| 4,154,411 | 5/1979 | Kamp et al. | 242/18 PW X |
| 5,016,829 | 5/1991 | Schippers et al. | 242/18 PW X |

FOREIGN PATENT DOCUMENTS

| | | | |
|---|---|---|---|
| 2052610 | 6/1970 | France | 242/18 PW |

*Primary Examiner*—Daniel P. Stodola
*Assistant Examiner*—Michael R. Mansen
*Attorney, Agent, or Firm*—Max Fogiel

[57] ABSTRACT

A device for constructing a thread reserve (6) wound parallel onto a bobbin (5 or 7) in a winder. The thread reserve is axially displaced in relation to the standard winding (4). The device has a reserve shackle (22) with two sections (24 & 25) that extend over the total width of the standard winding and slope together at an angle to the axis of the bobbin and toward a transition. The reserve shackle is moved back and forth by a drive mechanism in a motion that comprises one component perpendicular to the axis of the bobbin and another paralleling it. The reserve shackle has a distributing eye (23) at the transition between the sloping sections. A joint drive mechanism (27) travels back and forth at an angle to the axis of the bobbin to produce both components simultaneously. One of the components of the direction that the drive mechanism travels in is at an angle that ensures that the distributing eye will return from the vicinity of the standard winding to the vicinity of the thread reserve axially displaced thereto.

11 Claims, 2 Drawing Sheets

DEVICE FOR CONSTRUCTING A THREAD RESERVE WOUND PARALLEL ONTO A BOBBIN IN A WINDER

BACKGROUND OF THE INVENTION

The invention concerns a device for constructing a thread reserve wound with parallel turns onto a bobbin. When a thread reserve is wound with parallel turns, it is generally axially displaced from the standard bobbin winding. The standard technique in this case can be either high-precision or regular cross winding. A reserve is often constructed at the commencement of a bobbin trip (winding), when it will subsequently be necessary for example to tie the tail end of a foregoing bobbin to the leading end of a succeeding bobbin. It is, on the other hand, also possible to construct the reserve for a period of time at any instant during a bobbin trip, when for example defective thread is to be separated from regular thread.

German OS 2 328 828 discloses a device of the aforesaid type that constructs a thread reserve on a bobbin in a winder. The reserve is axially displaced in relation to the standard winding. This device employs a reserve shackle in the form of a surface with a thread-channeling edge that extends perpendicular to the bobbin axis. The purpose of this device is to wind the thread at the commencement of a winding process onto a reserve section that is axially displaced in relation to the standard winding. The reserve shackle also has a trailing edge followed by two sections that slope in opposite directions toward the axis of the bobbin and meet in a transition that is not recessed. To terminate the construction of a thread reserve at the commencement of a winding process, the reserve shackle is advanced by one drive mechanism perpendicular to the axis of the bobbin to allow the thread to cross the trailing edge and enter the adjacent area, where it can be intercepted by the traversing-thread guide, which initiates the standard winding process with the thread being distributed by the traversing-thread guide. Toward the end of the winding process another thread reserve can be wound onto the full bobbin and will accordingly not be axially displaced in relation to the standard winding. The two sections of the reserve shackle, which extend across the width of the winding, are pivoted for this purpose to where the thread is exiting, lifting it out of the traversing-thread guide and, due to the slope between the two sections, feeding it into the transition between them. Since the reserve shackle can now be moved toward and away from the axis of the bobbin to an extent that begins and ends within the width of the standard winding, the second thread reserve will occur toward the end of the winding process on the standard-wound bobbin. It is impossible to use this known device to wind another axially displaced thread reserve at any point of time during the winding process, especially not toward the end of a bobbin trip. Quite aside from the fact that the axial travel of the reserve shackle does not extend beyond the standard winding, the transition between the two sections does not constitute a stamped-out displacement eye in the actual sense and is accordingly incapable of retracting the thread over the forward wall once an axially displaced thread reserve has been constructed on a bobbin with an already considerable diameter, which would, however, be prerequisite for the traversing-thread guide to finally be able to intercept the thread.

SUMMARY OF THE INVENTION

The object of the present invention is to improve a device of the aforesaid type in order to allow construction of a thread reserve automatically and in accordance with a control pulse, whereby the construction of one or more thread reserves will be completely independent of how the thread is being distributed and can according be carried out at any desired time during a bobbin trip.

This object is attained in accordance with the invention by observing that what is important is first that there must be not only a transition between the two sections but also a stamped-out distributing eye to channel the thread with definition while winding over the faces of the bobbins. Finally, only one drive mechanism will be employed instead of the two known from prior art. This mechanism will extend at an angle to the axis of the bobbin so that it can execute both components of the motion simultaneously. The component that parallels the axis of the bobbin must be longer than it is at the generic state of the art to allow the distributing eye out of the vicinity of the standard winding and into that of the axially displaced thread reserve and back. The sections must also cover the total width of the standard winding, specifically when the reserve shackle is advanced far enough by the motion component perpendicular to the axis of the bobbin in initiating a thread reserve for the traveling thread, which is tensioned between the thread guide and the thread-compensation shackle, is intercepted by the reserve shackle and lifted out of the thread guide. The sections of the reserve shackle slope toward the axis of the bobbin spindle such that, dictated by the triangle of displacement, the thread will be automatically deflected at the particular section toward the distributing eye in the reserve shackle and the traveling thread will be intercepted by the eye. Since the two sections of the reserve shackle slope toward the distributing eye more or less in the form of a symmetrical gable, the eye will usually be located on a projection of the width of the standard winding. Since the drive mechanism is linear and acts at an angle to the axis of the bobbin spindle, the sloping angle of back-and-forth motion emits both a perpendicular and a parallel component to the axis of the spindle. As the linear drive mechanism advances at the beginning of a thread reserve, the reserve shackle lifts the thread out of the thread guide. The thread travels over the sloping sections and into the distributing eye. Toward the end of the linear drive mechanism's advance, the distributing eye forces the thread laterally out of the vicinity of the standard bobbin. The thread reserve is constructed. The thread reserve is then terminated by another control pulse from a return motion. The thread is extracted from the distributing eye over the face of the bobbin. Toward the end of the return motion the thread, which has been released by the distributing eye in the reserve shackle, again arrives against the thread-compensation shackle and travels, governed by the displacement triangle, automatically to where the standard winding is to be constructed. It is now intercepted by the shuttling thread guide, followed by the further construction of the standard winding. When, accordingly, a thread reserve is to be constructed at the midpoint of a bobbin trip for example wherein the standard winding has already been wound to a particular level, since no problems can result from the thread being prevented by the elevated edge adjacent to the thread reserve on the face of the standard winding from crossing over into the vicinity of the standard winding, the thread guide will also have no problems intercepting the thread. Since a thread-guide shackle with two sections is employed with the thread initially actively forced over the elevated edge by the distributing eye and its arrival in the vicinity of the standard winding ensured even after the thread reserve has been terminated, the subsequent interception of the thread by the thread guide will also be able to occur with no problem. The device with two sections in accordance with the invention is also especially practical for applications in which a thread arriving after having been coated for example must be wound. It often happens in this case that the coating cannot be applied satisfactorily until the coater is up to speed, which may not occur for several running meters, at which time the thread can be further processed. The device in accordance with the invention can in this event be initially employed until the coater is up to speed to apply the inadequately coated material in the capacity of a preliminary phase of the standard winding, high-precision cross-winding for example. Once it is apparent that the coating is satisfactory, a control pulse will initiate construction of a thread reserve, even at several winding heads for example, by starting the outgoing displacement drive mechanism. Every thread arriving at an individual winding head will accordingly be intercepted by its associated reserve shackle, inserted into the distributing eye, and wound simultaneously with the commencement of a thread reserve. Since the thread reserve will also be terminated at every winding head by a control pulse that arrives simultaneously, the resulting reserves will also all be approximately the same length in running meters. The incoming motion of the reserve shackle is then initiated, allowing the distributing eye in every shackle to retract the thread into the vicinity of standard winding. The threads are then simultaneously released from all the winding heads by the reserve shackle and intercepted by the thread guide in each threader, upon which the satisfactorily coated material will be wound on top of the unsatisfactorily coated material on the already intercepted bobbin. All that is necessary to make it possible to separate the two materials later is a single incision into the thread between the standard winding and the thread reserve to facilitate differentiation of the thread wound at the commencement of the thread reserve from the thread wound at its termination. It is of course also possible to wind several thread reserves one on top of another in this way even during a bobbin trip if for example the coating becomes defective again during the bobbin trip. In this case there will be only four threads, which will also be easy to distinguish, in the interval between the standard winding and the thread reserve.

It is accordingly possible in a practical way to construct a thread reserve at every point in a bobbin trip and specifically completely independent of the distribution procedure. It accordingly becomes possible to initiate and construct a thread reserve even when the bobbin spindle is powered. The invention also allows the construction of thread reserves at many winding heads simultaneously, whereby a pulse triggered by only one operator for the purpose of constructing a thread reserve can be effectuated at many winding heads at the same time. It is in a practical way no longer necessary for the thread to be inserted into the reserve shackle manually and it is also unnecessary to terminate construction of the reserve manually by removing the thread from the reserve shackle. Furthermore, several thread reserves can be constructed on a single bobbin, especially if the thread is supplied constantly and must be distributed by hand, as is the case with monofilaments. The distribution can, since it is completely independent of the construction of thread reserve, be carried out not only in the vicinity of the thread reserve but also somewhere in the vicinity of the bobbin. It accordingly becomes possible when winding to exploit high bobbin speeds from the very commencement, even when the thread is being supplied constantly.

The joint and sloping drive mechanism can be mounted on the housing of the winder's threader. It is especially easy to mount at this point without having to shift any of the other components of the winder.

The mechanism that drives the reserve shackle can have at least one pneumatic cylinder that it is connected to by a piston rod, whereby either the piston rod or the reserve shackle has an anti-rotation mechanism. The anti-rotation mechanism is necessary to ensure that the reserve shackle moves back and forth within a plane and is prevented from leaving it. An additional result is that the reserve shackle can be very wide and still move through below the thread-compensation shackle.

The free end of the section of the reserve shackle that faces away from the distributing eye has a bend more or less perpendicular to the axis of the bobbin. This bend is at the end of the section of the reserve shackle that faces the housing of the winder. Thus, even this critical point, the end of the standard winding facing away from the thread reserve, is reliably covered. It is of course also possible to construct the thread reserve on the bobbin between the standard winding and the machine housing instead of floating freely out. In this case the relationships will be reversed.

The reserve shackle and distributing eye, the sections, and the bend can consist of bent wire. This is a simple and cost-effective technique of manufacturing a reserve shackle. It can be covered with a wear-resistant and low-friction coating, especially ceramic, not only facilitating the sloping travel of an intercepted thread into the distributing eye but also reliably preventing local wear and hence notching of the reserve shackle while treating the material gently while the reserve is being constructed.

The pneumatic cylinder can be a double-action cylinder, allowing precise and synchronized control of both the backward and the forward motion. It is of course also possible to use several cylinders, even hydraulic cylinders, to establish the individual directional components of motion. This approach, however, somewhat complicates the device's design.

When the reserve shackle and distributing eye are shifted toward the free end of the bobbin spindle, the thread reserve will be constructed at the end facing away from the winder's housing and will be accordingly more easily accessed.

BRIEF DESCRIPTION OF THE DRAWINGS

Preferred embodiments of the invention will now be described with reference to the drawings, wherein.

DESCRIPTION OF THE PREFERRED EMBODIMENTS

Figure 2:
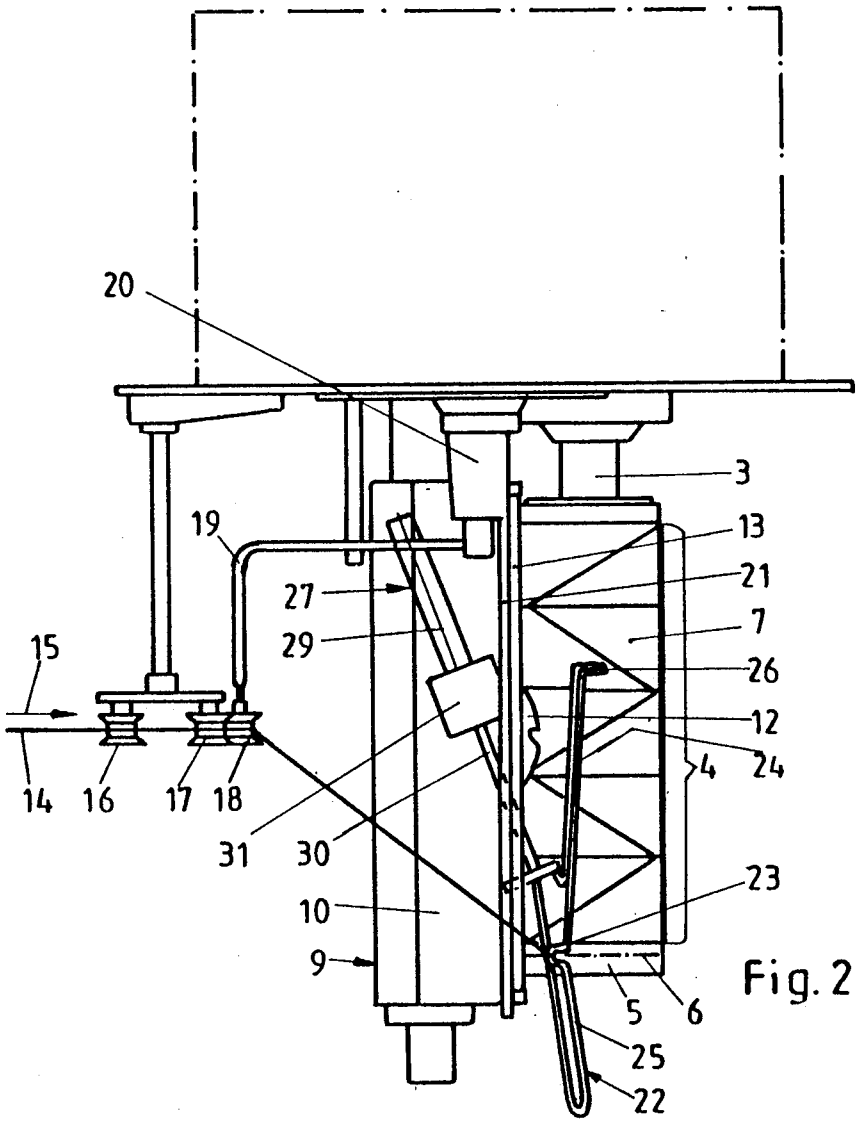
FIG. 2 is a top view of the device illustrated in FIG. 1 while the thread reserve is being wound.
Figure 1:
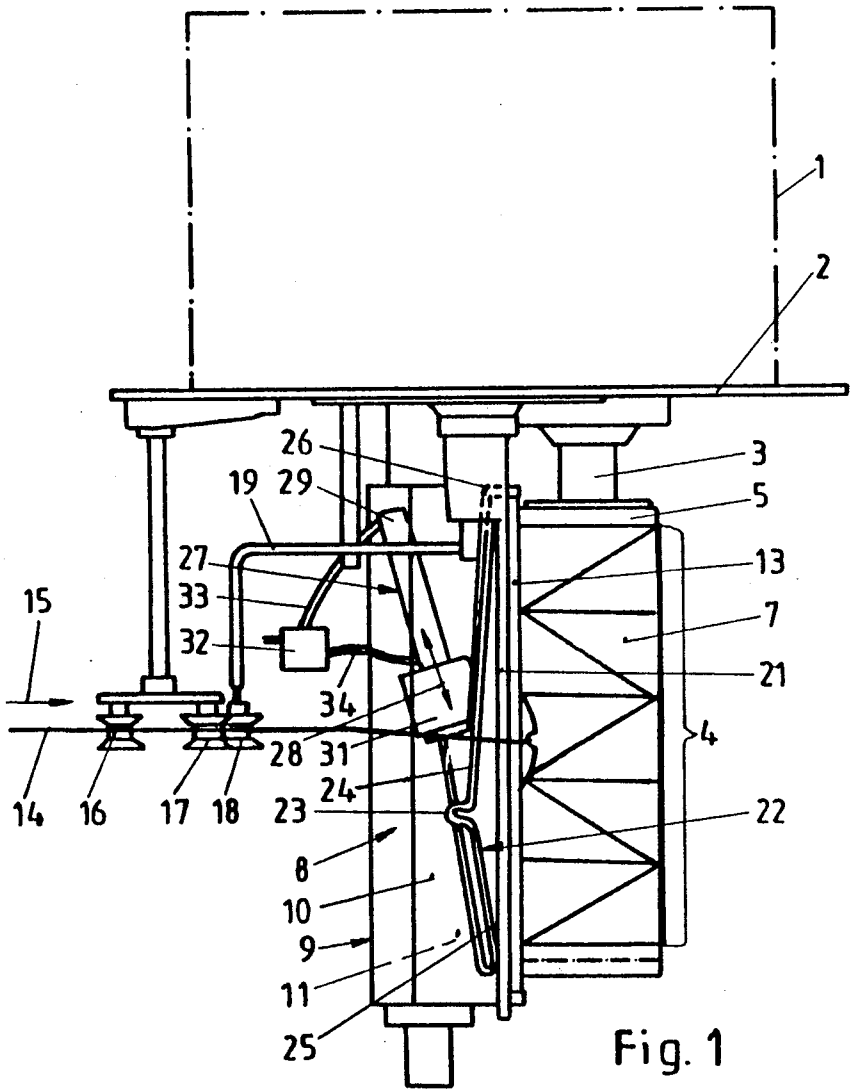
FIG. 1 is a top view of one embodiment of the device while a standard winding is being wound.

The housing 1 of a winder is represented in FIG. 1 by dot-and-dash lines. Housing 1 terminates in a vertical wall 2, from which essential components of the device extend forward in a cantilever design, whereas their associated drive mechanisms and transmissions are accommodated in housing 1. A bobbin spindle 3 that is to be wound with a standard winding 4, a precision cross-winding in this case, extends horizontally from vertical wall 2. Standard winding 4 is wound on a bobbin 5 that can be mounted on bobbin spindle 3 and removed therefrom for replacement. A space that will later accommodate a thread reserve 6 (FIG. 2) is represented by dot-and-dash lines axially displaced in relation to standard winding 4 on empty bobbin 5. It will be evident that thread reserve 6 should be wound axially displaced in relation to standard winding 4 on bobbin 5 and wound parallel to the standard winding 4. Next to wound bobbin 7, a conventional threader 8 is accommodated in a housing 9 that has a lid 10. Conventionally accommodated in threader housing 9 is a sweep-thread shaft 11 that moves a thread guide 12 back and forth over the width of standard winding 4. A pressure-relief roller 13 withdraws threader 8 as the diameter of wound bobbin 7 increases. The thread 14 that is to be wound is supplied in the direction represented by arrow 15 and by way of pulleys 16 and 17 to a roller 18 that rotates freely on the free end of a dancer arm 19. Dancer arm 19 pivots in a bearing 20 on vertical wall 2 in a plane that parallels that wall. The thread then travels over a thread-compensation shackle 21 and into a notch in thread guide 12 and is accordingly wound into the standard winding 4 on bobbin 7.

Figure 3:
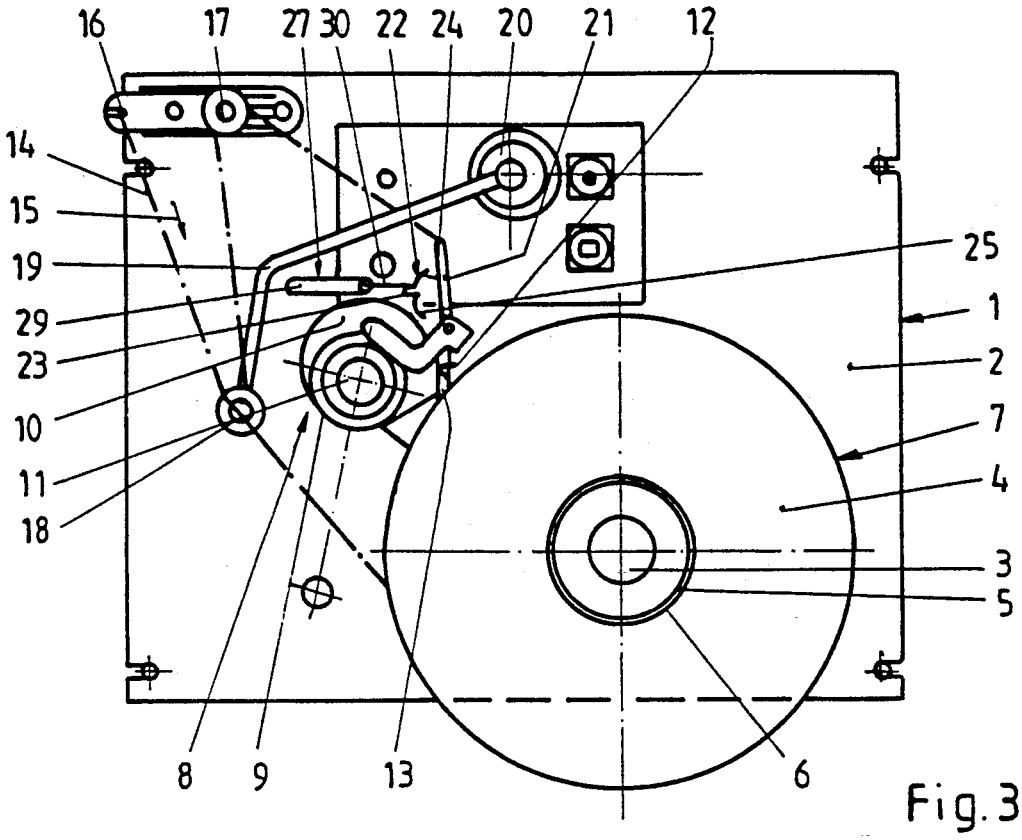
FIG. 3 is a side view of the device illustrated in FIG. 1.

Mounted on the housing 9 of threader 8 and especially on lid 10 is a distributing mechanism with a reserve shackle 22. Shackle 22 has a distributing eye 23 bordered by two sections 24 and 25 that are oppositely inclined toward the axis of bobbin spindle 3 and toward distributing eye 23. Reserve shackle 22 is, with its sections 24 and 25 longer than standard winding 4 is wide. There is a bend 26 at the end of the section 24 that faces vertical wall 2. A drive mechanism 27 shifts reserve shackle 22 back and forth in the direction represented by double-headed arrow 28 at an angle to the axis of vertical wall 2. FIG. 1 represents one limit of this motion, whereat reserve shackle 22 is disengaged and FIG. 2 the other limit, whereat thread reserve 6 is being wound. Drive mechanism 27 has two components, as will be evident from resolving the direction of motion into components parallel the axis of bobbin spindle 3 an perpendicular thereto. Drive mechanism 27 as a whole consists of a pneumatic cylinder 29 and of a piston rod 30. Reserve shackle 22 rests on piston rod 30. An anti-rotation mechanism 31 prevents piston rod 30 from rotating around its axis, maintaining reserve shackle 22 in a single plane so that it can also travel below the thread-compensation shackle 21. The particular inclination of sections 24 and 25 to the axis of bobbin spindle 3 ensures that thread 14 will, as soon as reserve shackle 22 has advanced it into the position illustrated in FIG. 2, come into contact with thread 14 and be lifted automatically out of thread guide 12. Thus, thread 14 will slide along the particular section 24 or 25 in question, and will be intercepted in the vicinity of distributing eye 23. As the motion continues toward the limit illustrated in FIG. 2, thread 14 winds out beyond standard winding 4 and arrives at empty bobbin 5, where thread reserve 6 is wound parallel. The appropriate pulse for switching the motion of drive mechanism 27 out of the disengaged state illustrated in FIG. 1 into the operating state illustrated in FIG. 2 can be obtained by way of an diverting valve 32 (FIG. 1), from which a pneumatic line 33 extends to drive mechanism 27, which is a double-action pneumatic cylinder 29. Diverting valve 32 can be activated electrically, which also makes it possible to provide similar valves and their associated distributing mechanisms at several winding heads and accordingly commence and terminate a thread reserve 6 at every head simultaneously. Another pneumatic line 34 leads to the other compression compartment in pneumatic cylinder 29. A corresponding changeover pulse will in this case force piston rod 30 in again, retracting reserve shackle 22 back out of the operating position illustrated in FIG. 2 and into the disengaged state illustrated in FIG. 1. Distributing eye 23 will entrain thread 14 along with it over the edge of standard winding 4 if a standard winding with a sufficient level or diameter has already been wound. Standard winding 4 will then be wound. It will be evident that the embodiment illustrated in FIG. 1 through 3 will make it possible to construct thread reserve 6 at any time during a bobbin trip—— beginning, middle, or end for example. The process of applying thread 14 to empty bobbin 5 is completely independent. It is for example possible to loop the thread around any point on empty bobbin 5 while bobbin spindle 3 is in operation, in the vicinity of standard winding 4 for example. When, accordingly, drive mechanism 27 s engaged, thread 14 will immediately be intercepted by reserve shackle 22 and thread reserve 6 will immediately begin winding without any significant standard winding 4. Several thread reserves 6 can also be wound one on top of another during one bobbin trip and, if they are all subject to the same electronic controls, at several winding heads as well.

Figure 4:
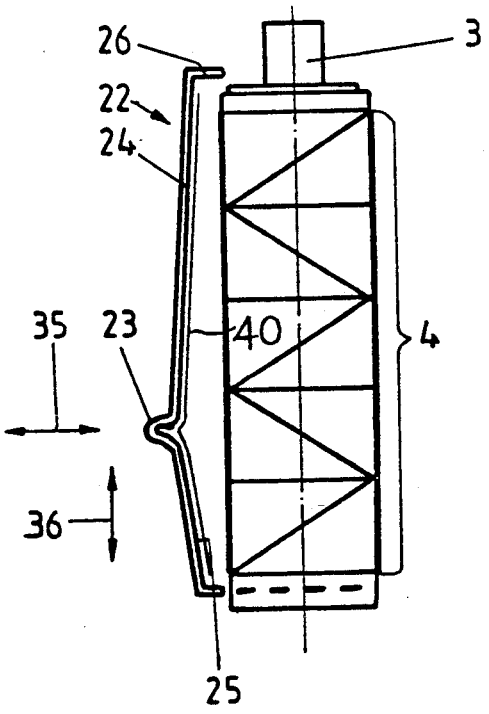
FIG. 4 is a schematic top view of components of another embodiment of the device.

It will again be evident from FIG. 4 that reserve shackle 22 has two sections 24 and 25 extending from distributing eye 23 on each side and must basically have one common drive mechanism or two superimposed drive mechanisms with one component of the motion represented by double-headed arrow 35 perpendicular to the axis of bobbin spindle 3 and another, represented by double-headed arrow 36, paralleling it. It will be evident that two separate cylinders can be provided and can be activated with a certain amount of overlap. When reserve shackle 22 moves back in the direction represented by double-headed arrow 36, distributing eye 23 will reliably move thread 14 over any edge of a standard winding 4 and into the vicinity of that winding, and, subsequent to the back-and-forth motion represented by double-headed arrows 35 and 36, the thread, which now rests against thread-compensation shackle 21, will reliably be intercepted by reserve shackle 22 as it moves back and forth, allowing a standard winding 4 to be commenced or continued. A device of this type is accordingly optimally appropriate for winding a standard winding 4 to a certain level, constructing a thread reserve 6, and then winding over the standard winding. When there is an upstream thread coater, it can be exploited to initially accommodate unsatisfactorily coated material at the bottom of a standard winding 4, establish a point of separation by winding a thread reserve 6, and wind the satisfactorily coated and usable material on top as a continuation of standard winding 4.

The reserve shackle 22 may be covered with a wear-resistant and low-friction coating 40.

We claim:

1. An arrangement for constructing a thread reserve on a bobbin comprising: a bobbin with axis carrying a standard winding of thread; said thread reserve being a reserve winding of thread displaced axially from said standard winding on said bobbin, said reserve winding having turns substantially parallel to turns of said standard winding; a reserve shackle with two sections extending over the total width of said standard winding and inclined oppositely tot eh axis of said bobbin and to a transition between said two sections; drive means for moving said reserve shackle with a back-and-forth motion that has one component of motion perpendicular to the axis of said bobbin and another component parallel to the axis of said bobbin; said reserve shackle having a distributing eye at said transition between said two sections; said drive means traveling back and forth at an angle tot eh axis of said bobbin to produce both said components simultaneously; one of said components being directed at an angle for returning said distributing eye from a vicinity of said standard winding to a vicinity of said reserve winding, said thread reserve being producible at any instant of time during winding of the bobbin through picking the thread up again after the thread has been released.

2. An arrangement as defined in claim 1, including threader means adjacent said bobbin and having a housing; and drive means being mounted on said housing.

3. An arrangement as defined in claim 1, wherein said drive means has at least one pneumatic cylinder connected to a piston rod; and anti-rotation means on said piston rod.

4. An arrangement as defined in claim 3, wherein said pneumatic cylinder comprises a double-acting cylinder.

5. An arrangement as defined in claim 1, wherein said drive means has at least one pneumatic cylinder connected to a piston rod; and anti-rotation means on said piston rod.

6. An arrangement as defined in claim 5, wherein said pneumatic cylinder comprises a double-acting cylinder.

7. An arrangement as defined in claim 1, wherein one or said two sections of said reserve shackle faces away from said distributing eye and has a free end with a bend substantially perpendicular to the axis of the bobbin.

8. An arrangement as defined in claim 7, wherein said reserve shackle, said distributing eye, and said sections as well as said bend are comprised of bent wire.

9. An arrangement as defined in claim 8, wherein said reserve shackle is covered with a wear-resistant and low-friction ceramic coating.

10. An arrangement as defined in claim 1, wherein said bobbin has a spindle with a free end, said reserve shackle and said distributing eye being shifted toward said free end of said bobbin spindle.

11. An arrangement for constructing a thread reserve on a bobbin comprising: a bobbin with axis carrying a standard winding of thread; said thread reserve being a reserve winding of thread displaced axially from said standard winding on said bobbin, said reserve winding having turns substantially parallel to turns of said standard winding; a reserve shackle with two sections extending over the total width of said standard winding and inclined oppositely to the axis of said bobbin and to a transition between said two section; drive means for moving said reserve shackle with a back-and-forth motion that has one component of motion perpendicular to the axis of said bobbin and another component parallel to the axis of said bobbin; said reserve shackle having a distributing eye at said transition between said two sections; said drive means traveling back and forth at an angle tot he axis of said bobbin to produce both said components simultaneously; one of said components being directed at an angle for returning said distributing eye from a vicinity of said standard winding to a vicinity of said reserve winding, said thread reserve being producible at any instant of time during winding of the bobbin through picking the thread up again after the thread has ben release; threader means adjacent said bobbin and having a housing, said drive means being mounted on said housing; said drive means having at least one pneumatic cylinder connected to a piston rod; anti-rotation means on said piston rod; one of said two sections of said reserve shackle facing away from said distributing eye and having a free end with a bend substantially perpendicular to the axis of the bobbin; said reserve shackle, said distributing eye, and said sections as well as said bend being comprised of bent wire; said reserve shackle being covered with a wear-resistant and low-friction ceramic coating; said pneumatic cylinder being a double-acting cylinder; said bobbin having a spindle with a free end, said reserve shackle and said distributing eye being shifted toward said free end of said bobbin spindle.

* * * * *